US008646902B2

(12) United States Patent
Toyoshima

(10) Patent No.: US 8,646,902 B2
(45) Date of Patent: Feb. 11, 2014

(54) INKJET RECORDING APPARATUS

(75) Inventor: Shinji Toyoshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 383 days.

(21) Appl. No.: 12/426,111

(22) Filed: Apr. 17, 2009

(65) Prior Publication Data

US 2009/0262174 A1 Oct. 22, 2009

(30) Foreign Application Priority Data

Apr. 18, 2008 (JP) ..... 2008-108562

(51) Int. Cl.
*B41J 2/01* (2006.01)
*B41J 2/165* (2006.01)
*B41J 2/185* (2006.01)

(52) U.S. Cl.
USPC ..... 347/104; 347/30; 347/36; 347/90; 347/101; 347/105

(58) Field of Classification Search
USPC ..... 347/22, 30, 35, 36, 90, 101, 104
See application file for complete search history.

(56) References Cited

U.S. PATENT DOCUMENTS 6,575,554 B2 * 6/2003 Yoshinaga ..... 347/22
2004/0169712 A1 * 9/2004 Tsuji ..... 347/104
2005/0093919 A1 * 5/2005 Takatsuka et al. ..... 347/30
2005/0122372 A1 * 6/2005 Shimizu ..... 347/22
2006/0181576 A1 * 8/2006 Endo et al. ..... 347/55
2007/0126832 A1 * 6/2007 Kito ..... 347/101
2007/0146456 A1 * 6/2007 Tanabe ..... 347/101
2007/0291096 A1 * 12/2007 Toyoshima ..... 347/104

FOREIGN PATENT DOCUMENTS

JP 61-095966 5/1986
JP 11-321016 11/1999

* cited by examiner

*Primary Examiner* — Charlie Peng
*Assistant Examiner* — Hung Lam
(74) *Attorney, Agent, or Firm* — Canon USA Inc. IP Division

(57) ABSTRACT

An inkjet recording apparatus includes a platen configured to support a recording medium at a position facing a recording head, a suction portion arranged at the platen and configured to suck the recording medium, an ink receiving portion arranged at the platen and configured to receive ink discharged on a region beyond an end of the recording medium, a negative pressure producing portion configured to produce a negative pressure to be applied to the suction portion and the ink receiving portion, and a communication portion causing the suction portion to communicate with the ink receiving portion at the outside of a conveyance region of the recording medium.

6 Claims, 5 Drawing Sheets

INKJET RECORDING APPARATUS

BACKGROUND OF THE INVENTION

1. Field of the Invention

The present invention relates to an inkjet recording apparatus that performs recording by discharging ink on a recording medium from a recording head, and more particularly to an inkjet recording apparatus including a platen that supports a recording medium and a negative pressure producing portion that causes the recording medium to be sucked to the platen.

2. Description of the Related Art

A printer, a copier, a facsimile, and a scanner, or a multifunction device and a system including these machines each use a recording apparatus that records an image on a recording medium such as a recording sheet by a recording head in accordance with image information. An inkjet recording apparatus that records an image by discharging ink on a recording medium from nozzles of a recording head is widely known.

In the inkjet recording apparatus, to provide stable recording, it is preferable to reduce influence of deformation of the recording medium such as wrinkling occurring when ink adheres to the recording medium. Various measures are known and suggested to maintain a distance between the recording medium and the recording head constant. For a curled recording medium, a measure is suggested to prevent the recording medium from being lifted at a platen of an image forming portion. If the recording medium is lifted, the recording medium may contact a recording head or a carriage, which may result in reduced image quality of a recorded image. If the recording medium contacts an ink discharge surface of the recording head, image quality and ink discharge performance may be adversely affected.

A configuration for reducing curling associated with the inkjet recording apparatus includes a sucking portion at a platen facing a recording head, and which performs recording while a recording medium is attracted to the platen. For example, as a suction platen, Japanese Patent Laid-Open No. 61-95966 discloses a configuration in which a suction groove is provided in a surface for supporting a recording medium, a suction hole is formed in the suction groove, and a negative pressure producing portion, such as a fan, applies a negative pressure to the suction hole, to suck the recording medium.

Japanese Patent Laid-Open No. 11-321016 discloses an inkjet recording apparatus including a configuration which performs borderless recording on a roll sheet as a recording medium without a margin. Japanese Patent Laid-Open No. 11-321016 describes recording by discharging ink on an outside region beyond an end of the recording medium in a width direction, and cuts the recording medium by a cutter at a rear end of a recording region in a conveyance direction. This configuration may include an ink receiving portion for receiving ink discharged on the region outside the recording medium in the width direction. The ink receiving portion is defined by a recessed portion being open to a platen. Also, an absorbent is provided in the ink receiving portion. The absorbent retains discharged ink. An exhaust hole is formed at a bottom portion of the ink receiving portion to guide the received ink to a waste ink reservoir.

A sucking force with a negative pressure is applied to the ink receiving portion in a similar manner to the suction groove. The sucking force is applied to prevent the exhaust hole from clogging with the ink ejected during borderless recording, to prevent a back surface of the recording medium from being contaminated with ink mist staying in the ink receiving portion during borderless recording, and to prevent the recording medium from being lifted at the ink receiving portion.

If a negative pressure is produced at the ink receiving portion substantially equal to the negative pressure applied to the suction groove, the ink discharged from the recording head may be affected by an airflow produced by the sucking force with the negative pressure. This may reduce image quality. Therefore, it is suggested that a negative pressure produced at the ink receiving portion is minimized to reduce or prevent the airflow produced by the sucking force.

A casing connected to the negative pressure producing portion, which may be a suction fan, is provided below the suction platen. The suction groove may communicate with the casing through the suction hole, and the ink receiving portion may communicate with the casing through an opening. The communication is established in order to apply the negative pressure to both the suction groove and the ink receiving portion by the single suction fan, thereby promoting reduction in size, manufacturing cost, and noise of the apparatus.

In the existing inkjet recording apparatus including the suction platen, when a large sucking force with a negative pressure is applied to the ink receiving portion, landing positions of ink droplets on a recording medium during borderless recording may shift due to the produced airflow. Hence, a minimum negative pressure is applied to the ink receiving portion. However, when recording is performed on a large-size recording medium while the recording medium extends over the ink receiving portion, the surface of the platen may have a region which actively sucks the recording medium, and a region which does not actively suck the recording medium. In other words, the recording medium is unevenly sucked to the platen surface which may cause lifting of the recording medium. Therefore, the existing suction platen has a region which does not actively suck the recording medium in a periphery of the ink receiving portion, where the recording medium is easily lifted. Attempts to prevent the landing positions of the ink droplets from being shifted may cause the suction force for the recording medium toward the platen to become uneven, and hence the recording medium may likely lift.

SUMMARY OF THE INVENTION

The present invention provides an inkjet recording apparatus capable of reducing landing positions of ink droplets from being shifted during borderless recording and preventing a recording sheet from being lifted.

According to an embodiment of the present invention, an inkjet recording apparatus configured to perform recording by discharging ink on a recording medium from a recording head is provided. The apparatus includes a platen configured to support the recording medium at a position facing the recording head, a suction portion arranged at the platen and configured to suck the recording medium, an ink receiving portion arranged at the platen and configured to receive ink discharged on a region beyond an end of the recording medium, a negative pressure producing portion configured to produce a negative pressure to be applied to the suction portion and the ink receiving portion, and a communication portion causing the suction portion to communicate with the ink receiving portion at the outside of a conveyance region of the recording medium.

Further features of the present invention will become apparent from the following description of exemplary embodiments with reference to the attached drawings.

DESCRIPTION OF THE EMBODIMENT

Figure 1:
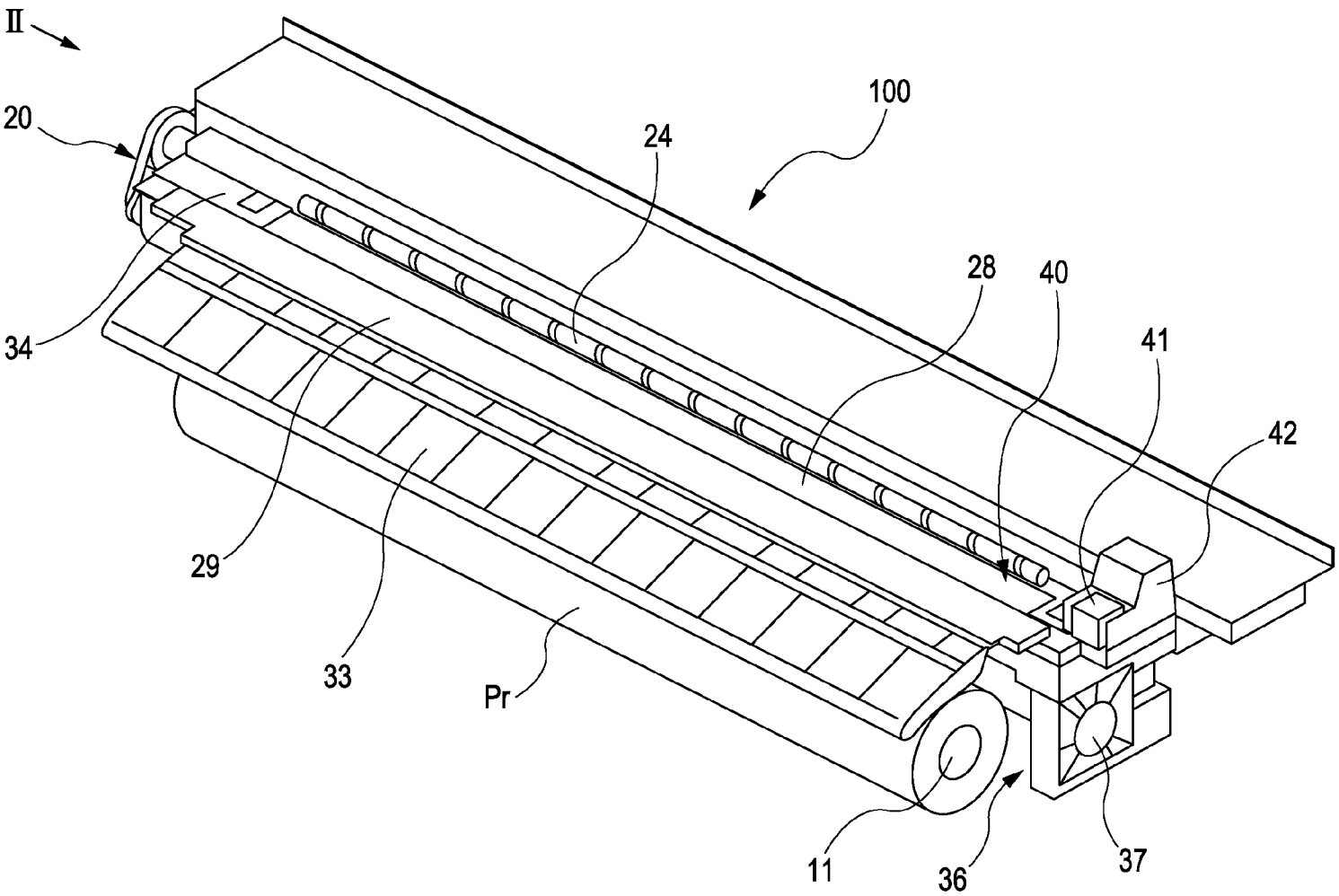
FIG. 1 is a perspective view showing an inkjet recording apparatus according to an embodiment.
Figure 2:
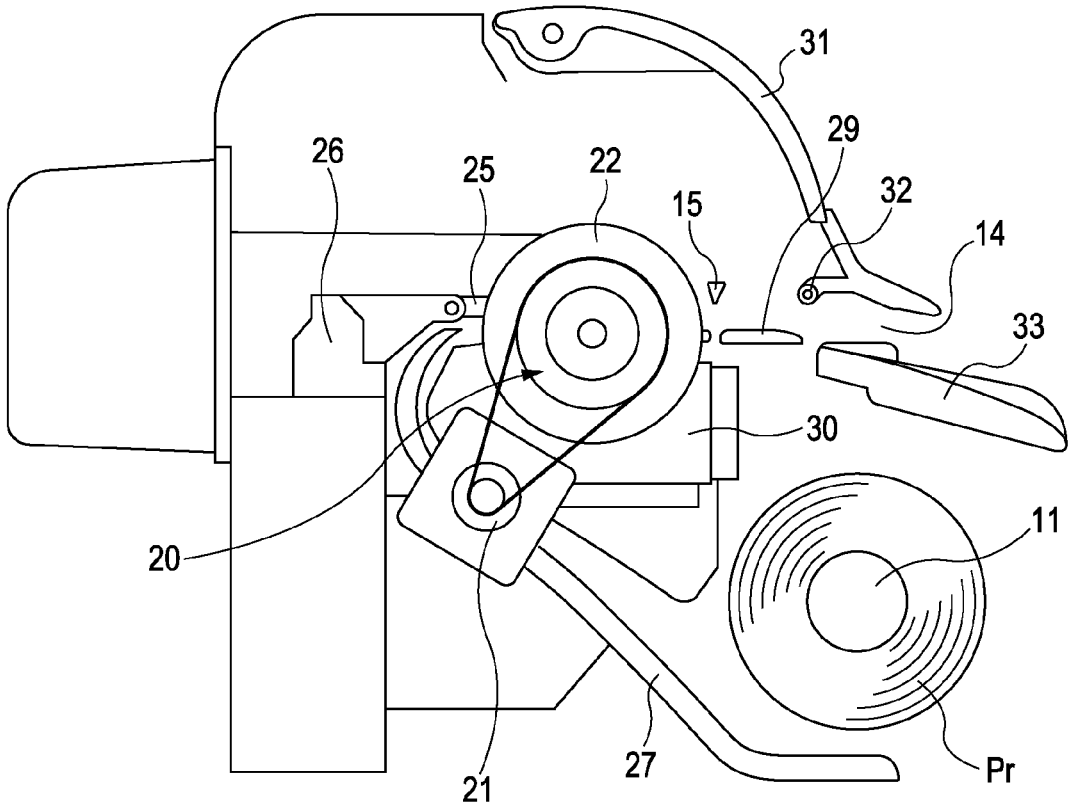
FIG. 2 is an elevated side view showing the inkjet recording apparatus according to the embodiment when viewed in a direction indicated by arrow II in FIG. 1.
Figure 3:
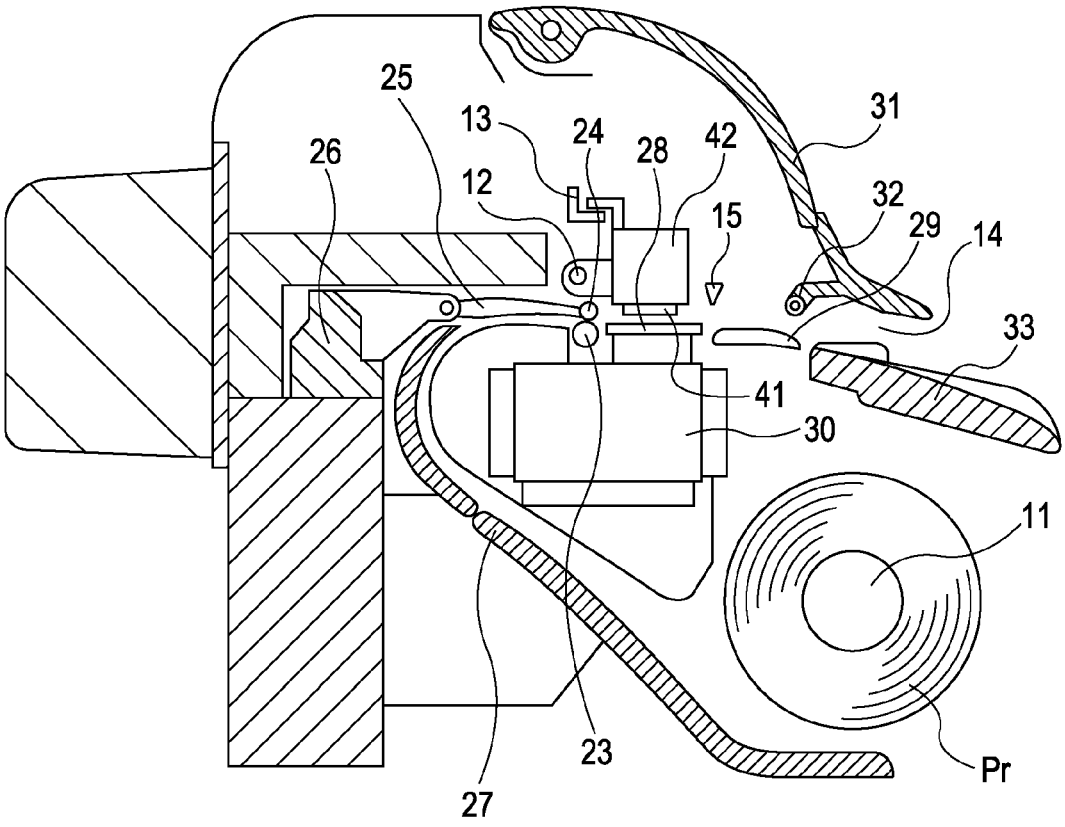
FIG. 3 is another elevated side view showing the inkjet recording apparatus according to the embodiment.

An embodiment of the present invention is described below with reference to the attached drawings. In the drawings, like numerals refer to like or corresponding components. FIG. 1 is a perspective view showing an inkjet recording apparatus according to an embodiment. FIG. 2 is an elevated side view showing the inkjet recording apparatus according to the embodiment when viewed in a direction indicated by arrow II in FIG. 1. FIG. 3 is another elevated side view showing the inkjet recording apparatus according to the embodiment. Referring to FIGS. 1 to 3, an inkjet recording apparatus 100 performs recording by discharging ink on a recording medium from a recording head. A roll sheet Pr wound in a rolled manner is used as a recording medium. The roll sheet Pr is mounted on a rotatable spur 11 with a paper core disposed therebetween, and is set such that the roll sheet Pr can be let off (fed).

In the apparatus, a conveyance mechanism 20 including a conveyance roller 23 is provided. The roll sheet Pr pinched between the conveyance roller 23 and a pinch roller 24 is let off from the spur 11 by rotation of the conveyance roller 23, fed along a conveyance guide 27, and conveyed in the apparatus. A platen 28 is arranged downstream of the conveyance roller 23 in a conveyance direction. A carriage 42, on which a recording head 41 is mounted, is arranged at a position facing the platen 28 movably in a reciprocating manner. The recording head 41 records an image on a recording medium by discharging ink in accordance with image information. The recording head 41, the carriage 42, and the platen 28 form a part of an image forming portion 40. A cutter 15 is arranged at a position near the downstream side of the platen 28 in the conveyance direction. The cutter 15 cuts the roll sheet. The recorded roll sheet is conveyed along an ejection guide 29 and along an upper surface of a roll sheet cover 33, and then, a rear end of a recording medium is cut by the cutter 15. The cut part is ejected to the outside of the apparatus through an ejection port 14.

A conveyance pulley 22 is fixed to a shaft of the conveyance roller 23. The conveyance roller 23 is rotationally driven when a drive force of a conveyance motor 21 is transmitted to the conveyance pulley 22. A pinch roller arm 25 rotationally supports the pinch roller 24. A pinch roller holder 26 elastically supports the pinch roller arm 25 such that the pinch roller 24 can contact or be separated from the conveyance roller 23. A preparatory discharge receiving portion 34 is arranged at a position within a movable range of the carriage 42 but not corresponding to the platen 28. The preparatory discharge receiving portion 34 receives ink preparatorily discharged from the recording head 41.

The carriage 42 with the recording head 41 mounted is guided and supported movably along a guide shaft 12 and a guide rail 13 in a reciprocating manner. The recording head 41 has a discharge surface facing the recording medium, the discharge surface having a nozzle row composed of a plurality of nozzles arranged at a predetermined pitch. When a plurality of colors of ink is used for color recording, the number of nozzle rows corresponds to the number of colors of ink.

Figure 4:
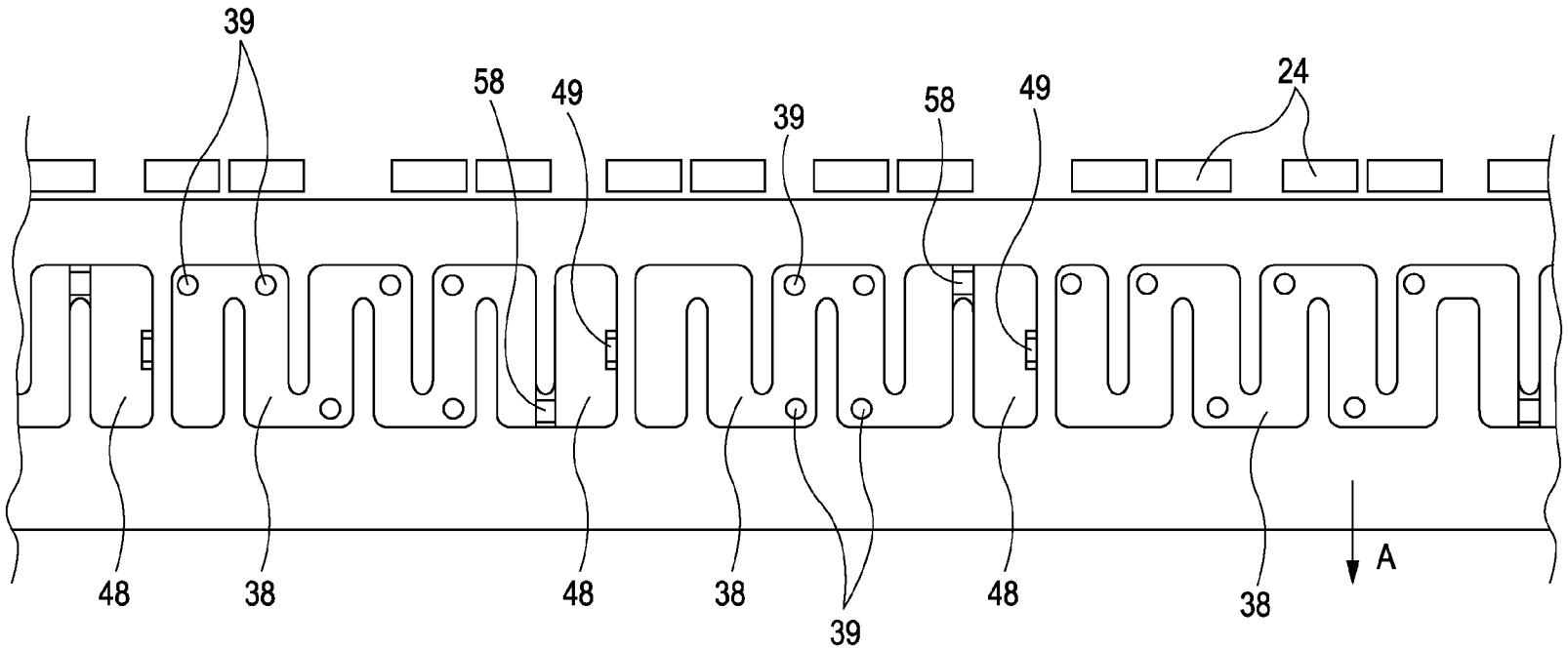
FIG. 4 is a top view showing a platen according to the embodiment.
Figure 5:
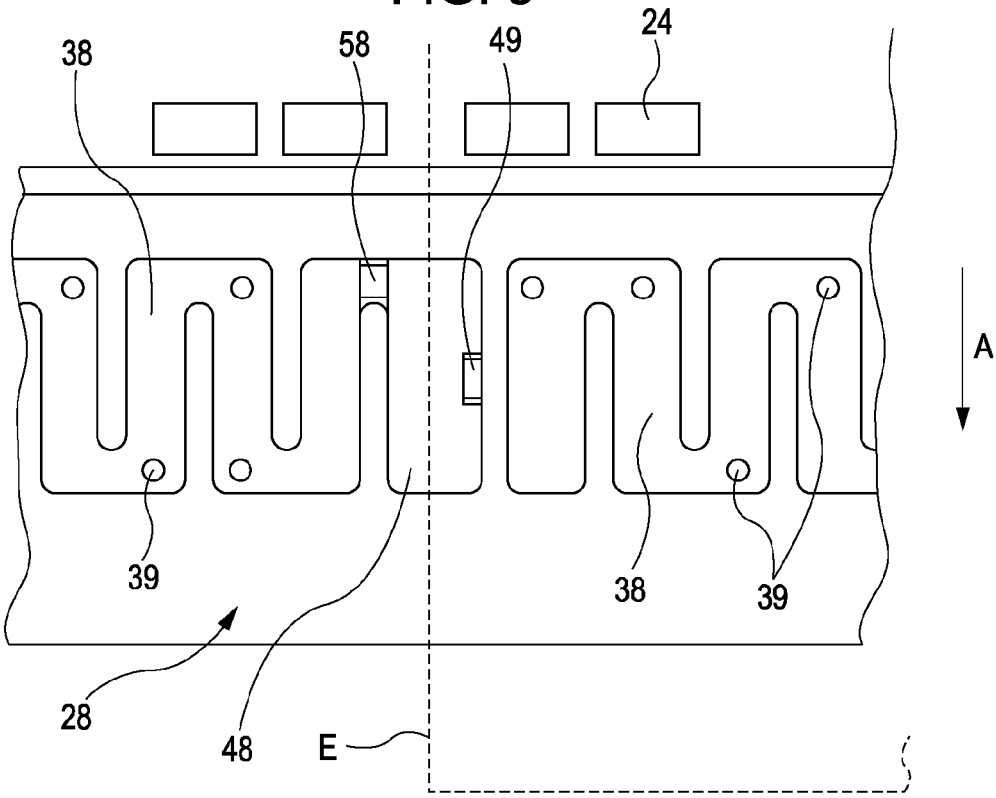
FIG. 5 is a top view partly showing the platen according to the embodiment when an end of a recording medium in a width direction extends to an ink receiving portion.
Figure 6:
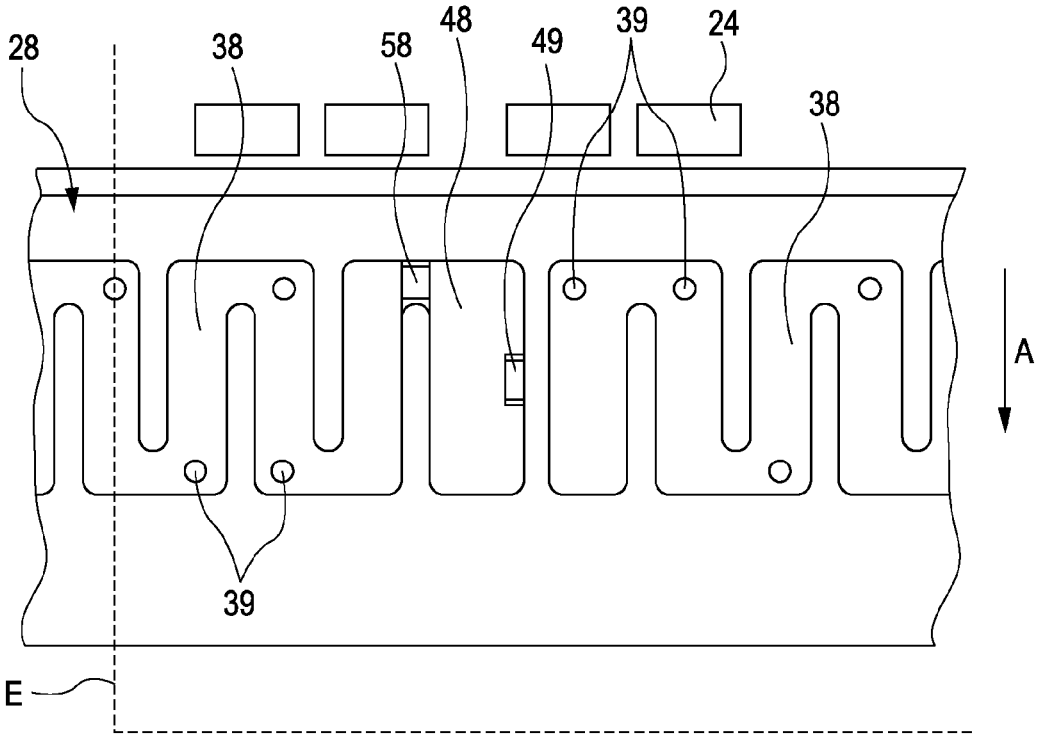
FIG. 6 is a top view partly showing the platen according to the embodiment when an end of a recording medium extends over the ink receiving portion.

FIG. 4 is a top view showing a platen according to the embodiment. FIG. 5 is a top view partly showing the platen according to the embodiment when an end of a recording medium in a width direction extends to an ink receiving portion. FIG. 6 is a top view partly showing the platen according to the embodiment when an end of the recording medium extends over the ink receiving portion. The platen 28 supports a recording medium at a position facing the recording head 41. The platen 28 is a suction platen which causes the recording medium to be sucked to the platen by a sucking force with a negative pressure. The platen 28 is configured to suck the recording medium at an upper surface of a hollow casing 30 (FIG. 3). The inside of the casing 30 is connected to a suction fan 37 (FIG. 1), serving as a negative pressure producing portion. The suction fan 37 causes the recording medium to be sucked to the platen 28.

The platen 28 has a plurality of recessed suction portions 38 with a predetermined arrangement in the width direction of the recording medium. Each suction portion 38 has a plurality of suction holes 39 with a predetermined arrangement. The suction holes 39 communicate with the inside of the casing 30. The casing 30 is bonded to a substantially entire lower surface of the platen 28 such that the casing 30 is hermetically sealed. The suction fan 37 is mounted to an end portion of the casing 30. The suction fan 37, its drive source, etc., define a suction fan unit 36.

Arrow A in FIGS. 4 to 6 indicates the conveyance direction of the recording medium. A dust cover 31 openable and closable with respect to a main body of the apparatus is provided downstream of the ejection guide 29 in the conveyance direction of the recording medium and above a conveyance path of the recording medium. A guide driven-roller 32 is rotatably supported by the inner surface of the dust cover 31. The guide driven-roller 32 guides the recording medium (roll sheet) toward the ejection port 14. The guide driven-roller 32 prevents the recording medium conveyed onto the platen 28 from being lifted so as to prevent the recording medium from contacting the recording head 41 or the carriage 42. The configuration is effective for recording on a recording medium which is curled, or for recording in undesired environmental conditions such as low humidity.

A plurality of recessed ink receiving portions 48 are provided at the platen 28 at portions respectively containing ends E of recording media of available various sizes in the width direction. Each of the ink receiving portions 48 receives ink discharged on a region beyond an end E of a recording medium in the width direction when borderless recording (no-margin recording) is performed on the recording medium. The ink receiving portions 48 are provided at the plural portions to correspond to the sizes (widths) of the recording media. Each of the ink receiving portions 48 is formed in a certain region at the inner side and the outer side of the recording medium at the portions containing the end E of the recording medium of the corresponding size. Hence, the ink receiving portions 48 and the suction portions 38 are arranged at the platen 28 alternately in the width direction of the recording medium.

An absorbent is provided in each of the ink receiving portions 48. The absorbent absorbs and retains ink discharged from the recording head 41. An opening 49 is formed at each of the ink receiving portions 48 at a position close to the inner portion of the recording medium (in FIG. 5, at an end of a right section). Through the opening 49, a negative pressure is applied by the suction fan 37, thereby exhausting the ink in the ink receiving portion 48 to the outside. In this embodiment, the opening 49 communicates with the inside of the casing 30. In particular, in this embodiment, the negative pressure produced by the common suction fan 37 is applied to the suction holes 39 of the suction portions 38 and the openings 49 of the ink receiving portions 48 through the inside of the casing 30. Accordingly, the suction of the recording medium by the suction portions 38 and the exhaust of the waste ink from the ink receiving portions 48 can be performed by the single suction fan 37.

Each of the ink receiving portions 48 is formed in a region with a predetermined width containing the end of the recording medium in the width direction. If airflow (suction amount) through the opening 49 is increased, the negative pressure is applied to the platen 28 from a region outside the ink receiving portion 48, and this may produce air turbulence. The air turbulence may shift landing positions of ink droplets on the recording medium during image recording, and hence, may reduce image quality. Therefore, the airflow through the opening 49 of each ink receiving portion 48 is minimized within a range necessary for exhaust of ink and recovery of floating mist.

Further, a communication groove 58 communicating with an adjacent suction portion 38 is formed at each ink receiving portion 48 at a position close to the outer side of the recording medium in a conveyance region (in FIG. 6, an end in a left section). Hence, referring to FIG. 6, the ink receiving portion 48 covered with the recording medium has a negative pressure therein which is equivalent to the negative pressure in the suction portion 38. Accordingly, the recording medium conveyed on the platen 28 can be evenly sucked, and the recording medium can be prevented from being lifted due to wrinkling or the like.

If the communication groove 58 is provided at the ink receiving portion 48 at a position near the inner side of the recording medium in the conveyance region (in FIG. 5, at an end in the right section), the negative pressure of the suction portion 38 at the inner side of the recording medium may be released to the outside through the ink receiving portion 48 at the end of the recording medium. The suction force with the negative pressure at the suction portion 38 may be decreased, and the recording medium may be lifted. Also, ink mist may adhere to the platen 28.

With the platen 28 having the above-described configuration, the negative pressure applied to the ink receiving portion 48 is decreased. Accordingly, the landing positions of the ink droplets on the recording medium can be prevented from being shifted when borderless recording is performed. In the region covered with the recording medium, the negative pressure of the suction portion 38 is set equivalent to the negative pressure of the ink receiving portion 48. Accordingly, the suction force applied to the recording medium on the platen 28 can be equalized, thereby preventing the recording medium from being lifted.

The ink receiving portion 48 having a similar configuration to that described above may be an ink receiving portion that receives ink to be discharged not for recording. The ink discharge not for recording is an operation for maintaining a discharge performance of the recording head 41, and therefore is referred to as preparatory discharge. The ink receiving portion 48 can be configured to provide either or both a function of receiving ink discharged on a region beyond a recording medium during borderless recording, and a function of receiving ink discharged during preparatory discharge. In particular, an ink receiving portion for receiving ink not for recording may be provided at the platen 28, and the ink receiving portion may have an opening 49 to which a negative pressure is applied by the negative pressure producing portion and a communication groove 58 communicating with a suction portion 38.

In the above-described embodiment, the inkjet recording apparatus using the roll sheet as a recording medium is described. The present invention may be applied to an inkjet recording apparatus using a cut sheet as a recording medium.

Further, in the above-described embodiment, the inkjet recording medium of serial type in which recording is performed by the recording head mounted on the carriage is described. The present invention may be applied to an inkjet recording apparatus of line type in which recording is performed only by sub-scanning.

With the embodiment of the present invention, the inkjet recording apparatus can be provided, which is capable of preventing the landing positions of the ink droplets from being shifted during borderless recording and preventing the recording medium from being lifted.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-108562 filed Apr. 18, 2008, which is hereby incorporated by reference herein in its entirety.

What is claimed is:

1. An inkjet recording apparatus for performing borderless recording by discharging ink on a recording medium from a recording head, the apparatus comprising:

a platen configured to support the recording medium being moved in a moving direction, on a supporting portion facing the recording head;

a first suction portion provided at the supporting portion of the platen and configured to suck the recording medium while recording;

a second suction portion provided at the supporting portion of the platen and configured to suck the recording medium while recording;

an ink receiving portion provided between the first and the second suction portions at the supporting portion of the platen, and configured to receive ink discharged beyond an end of the recording medium when performing the borderless recording on the recording medium being sucked by the first suction portion and not being sucked by the second suction portion, wherein the second suction portion is disposed outside of the first suction portion with respect to the recording medium in a second direction perpendicular to the first direction, and the first suction portion, the ink receiving portion and the second suction portion are arranged separately at the supporting portion along the second direction;

a negative pressure generator configured to produce a negative pressure to be applied to the first and the second suction portions and the ink receiving portion; and a communication groove formed at the supporting portion of the platen, the communication groove being disposed between the ink receiving portion and the second suction portion and not being disposed between the ink receiving portion and the first suction portion, causing the second suction portion and the ink receiving portion to communicate with each other through the communication groove when the ink receiving portion and the communication groove are covered with the recording medium.

2. The inkjet recording apparatus according to claim 1, wherein a suction hole is arranged in each of the first and the second suction portions, the negative pressure produced by the negative pressure generator being applied to the suction hole.

3. The inkjet recording apparatus according to claim 2, wherein an opening is arranged in the ink receiving portion, the negative pressure produced by the negative pressure generator being applied to the opening.

4. The inkjet recording apparatus according to claim 3, wherein the opening is arranged in the ink receiving portion at a position close to an inner side of the recording medium.

5. The inkjet recording apparatus according to claim 1, wherein a plurality of the first and the second ink receiving portions are arranged at a plurality of positions to correspond to different sizes of recording media.

6. The inkjet recording apparatus according to claim 1, wherein the ink receiving portion is configured to receive ink preparatorily discharged from the recording head, the negative pressure produced by the negative pressure generator being applied to the ink receiving portion.

* * * * *